US011415357B2

(12) United States Patent
Fei et al.

(10) Patent No.: US 11,415,357 B2
(45) Date of Patent: Aug. 16, 2022

(54) BRANCHED AIR SUPPLY DEVICE AND REFRIGERATOR

(71) Applicant: HAIER SMART HOME CO., LTD., Shandong (CN)

(72) Inventors: Bin Fei, Qingdao (CN); Xueli Cheng, Qingdao (CN); Dengqiang Li, Qingdao (CN); Xiaobing Zhu, Qingdao (CN); Kui Zhang, Qingdao (CN)

(73) Assignee: HAIER SMART HOME CO., LTD., Qingdao (CN)

( * ) Notice: Subject to any disclaimer, the term of this patent is extended or adjusted under 35 U.S.C. 154(b) by 129 days.

(21) Appl. No.: 16/958,879

(22) PCT Filed: Dec. 12, 2018

(86) PCT No.: PCT/CN2018/120694
§ 371 (c)(1),
(2) Date: Jun. 29, 2020

(87) PCT Pub. No.: WO2019/128718
PCT Pub. Date: Jul. 4, 2019

(65) Prior Publication Data

US 2020/0355421 A1 Nov. 12, 2020

(30) Foreign Application Priority Data

Dec. 29, 2017 (CN) ..... 201711484729.0

(51) Int. Cl.
*F25D 17/06* (2006.01)
*F25D 11/02* (2006.01)

(52) U.S. Cl.
CPC ..... *F25D 17/062* (2013.01); *F25D 11/02* (2013.01); *F25D 2317/0666* (2013.01);
(Continued)

(58) Field of Classification Search
CPC ..... F25D 2317/0681; F25D 2317/0672; F25D 2317/0667; F25D 17/062; F25D 17/045;
(Continued)

(56) References Cited

U.S. PATENT DOCUMENTS 4,476,773 A * 10/1984 Fehr ..... B60H 1/00471 137/625.47
6,058,726 A 5/2000 Noritake

FOREIGN PATENT DOCUMENTS

AU 3688299 A 1/2001
CN 105650980 A 6/2000
(Continued)

OTHER PUBLICATIONS

1st Office Action for EP Application No. 18895404.4 dated Jan. 18, 2021 (5 pages).
(Continued)

*Primary Examiner* — Cassey D Bauer
(74) *Attorney, Agent, or Firm* — Alston & Bird LLP

(57) ABSTRACT

A branched air supply device includes: a shell having a peripheral wall portion, with the peripheral wall portion being provided with a plurality of air supply ports; a plurality of baffles, with each of the baffles being rotatably mounted at one of the air supply ports; a plurality of transmission assemblies, with each of the transmission assemblies being provided with a rotating member and a first transmission mechanism, and each of the first transmission mechanisms being configured to transmit a rotational motion of a corresponding rotating member to one of the baffles, so that the baffle is at rest or rotates; and a driving device having a driving source and a second transmission mechanism, with the second transmission mechanism being configured to transmit one motion, output by the driving source,
(Continued)

to the plurality of rotating members, so that each of the rotating members is at rest or rotates.

8 Claims, 8 Drawing Sheets

(52) U.S. Cl.
CPC ..... *F25D 2317/0667* (2013.01); *F25D 2317/0672* (2013.01); *F25D 2317/0681* (2013.01)

(58) Field of Classification Search
CPC . F24F 2013/1446; F24F 13/1413; F24F 1/028
See application file for complete search history.

(56) References Cited

FOREIGN PATENT DOCUMENTS

| | | | | |
|---|---|---|---|---|
| CN | 101073572 | A | 10/2007 | |
| CN | 104266435 | A | 1/2015 | |
| CN | 104677018 | A | 6/2015 | |
| CN | 104879993 | A | 9/2015 | |
| CN | 106196838 | A | 12/2016 | |
| CN | 106286327 | A | 1/2017 | |
| CN | 106523433 | A | 3/2017 | |
| CN | 106642935 | A | 5/2017 | |
| CN | 106766569 | * | 5/2017 | ..... F25D 11/00 |
| CN | 106766569 | A | 5/2017 | |
| CN | 106871549 | A | 6/2017 | |
| CN | 108050751 | A | 5/2018 | |
| CN | 108253692 | A | 7/2018 | |
| CN | 108266950 | A | 7/2018 | |
| CN | 108302873 | A | 7/2018 | |
| CN | 108302874 | A | 7/2018 | |
| CN | 108302875 | A | 7/2018 | |
| EP | 2789937 | A1 | 10/2014 | |
| JP | H09303936 | A | 11/1997 | |
| JP | 3583603 | B2 | 6/2003 | |
| JP | 2003176971 | A | 4/2004 | |
| WO | WO 2017/152580 | A1 | 9/2017 | |

OTHER PUBLICATIONS

2nd Office Action for EP Application No. 18895404.4 dated Jun. 10, 2021 (5 pages).
Extended European Search Report for EP Application No. 18895404.4 dated Dec. 18, 2020 (4 pages).
International Search Report of PCT/CN2018/120694 dated Mar. 1, 2019 (8 pages).
Written Opinion of PCT/CN2018/120694 dated Mar. 1, 2019 (4 pages).
1st Search Report for CN2017114847290 dated Aug. 16, 2019 (3 pages).
1st Office Action for CN2017114847290 dated Aug. 27, 2019 (5 pages).
3rd Office Action for European Application No. 18895404.4 dated Nov. 24, 2021 (6 pages).

* cited by examiner

BRANCHED AIR SUPPLY DEVICE AND REFRIGERATOR

CROSS-REFERENCE TO RELATED APPLICATIONS

The present application is a national phase entry of International Application No. PCT/CN2018/120694, filed Dec. 12, 2018, which claims priority to Chinese Patent Application No. 201711484729.0, filed Dec. 29, 2017, which are incorporated herein by reference in their entirety.

FIELD OF THE INVENTION

The present application relates to the field of article storage in refrigerators, and more particularly relates to a branched air supply device and a refrigerator.

BACKGROUND OF THE INVENTION

Currently, an air-cooled refrigerator generates cold air through a built-in evaporator, and the cold air circularly flows to each storage chamber of the refrigerator through an air duct to realize refrigeration. For the air-cooled refrigerator, the freshness-maintaining performance of food greatly depends on whether the airflow circulation in the storage chamber is reasonable or not. If the cold air flows randomly through the air duct, excessive or insufficient air quantity entering each storage chamber may be easily caused, so that the temperature distribution in the storage chamber is unbalanced, and the operating efficiency of the refrigerator may also be reduced. Therefore, there is a need of performing accurate flowing direction distribution and flow rate control on the cold air entering each storage chamber. Identically, in order to optimize a storage space, a single storage chamber is generally separated into a plurality of refined storage spaces by storage devices such as storage racks or drawers. Each storage space requires different refrigerating capacity according to the quantity of stored articles, so that if the cold air directly enters the storage chamber from a certain position of the storage chamber without control, the problem that parts of the storage spaces are overcooled, but the refrigerating capacity of parts of the storage spaces is insufficient may be caused.

BRIEF DESCRIPTION OF THE INVENTION

By aiming at the above problems, the present application is proposed so as to provide a refrigerator capable of overcoming the problem or at least partially solving the problem and a branched air supply device for the refrigerator.

Therefore, the flow path and flow rate of cold air are uniformly and conveniently adjusted, so as to reasonably distribute the cold air according to the refrigerating capacity requirements of different storage chambers and refrigerating capacity requirements of different positions of one storage chamber, and enhance the freshness-maintaining performance and operating efficiency of the refrigerator. Moreover, the control is simple; the adjustment is convenient; the adjustment speed is high; and the adjustment accuracy is high.

In one aspect, the present application provides a branched air supply device for a refrigerator, including:

a shell, provided with a peripheral wall portion, a plurality of air supply ports being arranged on the peripheral wall portion and sequentially arranged at intervals in a peripheral direction of the shell;

a plurality of baffles, each of the baffles being rotatably arranged at one of the air supply ports so as to adjust an air outlet area of the corresponding air supply port by rotating to different rotating positions;

a plurality of transmission assemblies, each of the transmission assemblies being provided with a rotating member and a first transmission mechanism; each of the first transmission mechanisms being configured to transmit a rotational motion of the corresponding rotating member to one of the baffles so that the baffle is at rest or rotates; and a driving device, provided with a driving source and a second transmission mechanism, the second transmission mechanism being configured to transmit one motion, output by the driving source, to the plurality of rotating members so that each of the rotating members is at rest or rotates.

Optionally, a cam slide groove is formed in one side surface of each of the rotating members; and each of the first transmission mechanisms includes:

a first gear, connected to the corresponding baffle; and a transmission device, provided with an insertion portion inserted into the corresponding cam slide groove so as to be at rest or move in a radial direction of the corresponding rotating member when the corresponding rotating member rotates; and the transmission device further being provided with first teeth engaged with the corresponding first gear so that the corresponding baffle is driven to rotate when the transmission device moves in the radial direction of the corresponding rotating member.

Optionally, the second transmission mechanism includes a second gear; a plurality of second teeth are arranged on each of the rotating members; and the second gear is directly or indirectly connected to the driving source, the second gear is an external gear, and is engaged with the second teeth on the plurality of rotating members so as to drive the plurality of rotating members to rotate.

Optionally, each of the transmission devices includes a rack, the rack is provided with the first teeth, and one end of the rack is provided with the insertion portion; or each of the transmission devices includes:

a sliding strip, one end of the sliding strip being provided with the first teeth, and one side, facing the corresponding rotating member, of the sliding strip being provided with a groove;

a slide block, arranged in the groove and provided with an insertion portion; and an elastic member, arranged between the slide block and one side wall of the groove, which side wall of the groove is vertical to a length direction of the sliding strip.

Optionally, the driving source is a motor; the second transmission mechanism further includes a third gear arranged at an output shaft of the motor; and the third gear is engaged with the second gear.

Optionally, the shell further includes:

a damper bottom cover;

a base, arranged at one side of the damper bottom cover, the second gear and the plurality of rotating members being arranged between the base and the damper bottom cover; and the peripheral wall portion being arranged at one side, backing to the damper bottom cover, of the base; and a damper top cover, arranged at one end, far away from the base, of the peripheral wall portion; and an air inlet port being arranged on the peripheral wall portion or the damper top cover.

Optionally, an air providing device is further included. The air providing device is arranged in the shell, and is configured to enable an airflow to enter the shell and to flow out of the shell through one or more of the plurality of air supply ports.

Optionally, the air providing device is a centrifugal impeller, and is configured to enable the airflow to enter the shell in an axial direction of the shell.

Optionally, the quantity of the air supply ports is N, and the plurality of rotating members synchronously rotate; and each of the cam slide grooves includes at least $2^N-1$ slide groove sections, when the insertion portion is positioned at each end point of each slide groove section, the corresponding baffle closes the corresponding air supply port or completely opens the corresponding air supply port, so that when the plurality of rotating members synchronously rotate for degrees of a central angle corresponding to one slide groove section in each time, the plurality of air supply ports have one air outlet state, and further, the plurality of air supply ports have $2^N$ air outlet states.

In another aspect, the present application further provides a refrigerator, including:

a refrigerator body, internally provided with a storage space;

an air duct assembly, arranged in the refrigerator body and provided with a plurality of cold air outlet ports; the plurality of cold air outlet ports being communicated with the storage space; and any of the branched air supply device provided above, arranged in the air duct assembly; each of the air supply ports of the branched air supply device communicating with one or more of the plurality of cold air outlet ports; and each cold air outlet port communicating with one air supply port so that an airflow entering the shell of the branched air supply device flows to the storage space through one or more of the plurality of air supply ports of the branched air supply device.

Since the branched air supply device and the refrigerator of the present application include the plurality of air supply ports, the plurality of baffles may be driven to rotate by controlling one driving source, thus realizing the selection on air outlet ducts or the adjustment on air outlet capacity in each air outlet duct. Therefore, the cold air is reasonably distributed according to the refrigerating capacity requirements of different storage chambers or the refrigerating capacity requirements in different positions of one storage chamber, and the freshness-maintaining performance and the operating efficiency of the refrigerator are enhanced. Additionally, complete sealing of the air duct may be realized, and air leakage is prevented.

Further, the plurality of air supply ports of the branched air supply device of the present application are distributed in a circumferential way, so that circumferential air inlet and air outlet of a plurality of (for example, three) air supply ports may be realized, an integral structure design of the branched air supply device may be facilitated, and the branched air supply device may realize a simple and compact structure and a reasonable layout. The branched air supply device may also be conveniently installed in the refrigerator, and air ducts may be conveniently and reasonably arranged in the refrigerator. Additionally, in the branched air supply device of the present application, the driving device is configured to drive the plurality of rotating members to rotate at the same time, and rotation of the plurality of baffles is further realized, so that few components are used, and transmission is convenient and accurate.

Further, since each transmission device in the branched air supply device of the present application is provided with the sliding strip, the slide block and the elastic member, and the position of the slide block may be adjusted by the elastic member, so that the slide block is always in a stable state. Further, the transmission between the sliding strip and the first gear is more stable, the turning of the baffles is more stable, the adjustment is accurate, and the noise is low.

Further, the air providing device is arranged in the branched air supply device and the refrigerator of the present application, so that the air supply efficiency of the branched air supply device is obviously improved, and the branched air supply device may realize independent air inlet, and is particularly applicable to a double-system or multi-system refrigerator. Particularly, a centrifugal blower may be adopted to supply air, and such a design is particularly applicable to direct air outlet of a cooling chamber of the refrigerator.

These and other objectives, advantages and features of the present application will become more apparent to those skilled in the art from the following detailed description of specific embodiments of the present application with reference to accompanying drawings hereafter.

BRIEF DESCRIPTION OF THE DRAWINGS

Some specific embodiments of the present application will be described in detail hereinafter, in an exemplary but non-limiting way, with reference to the accompanying drawings. The same reference numbers in the drawings refer to the same or similar components or parts. Those skilled in the art will appreciate that the drawings are not necessarily drawn to scale. In the drawings.

DETAILED DESCRIPTION

Figure 1:
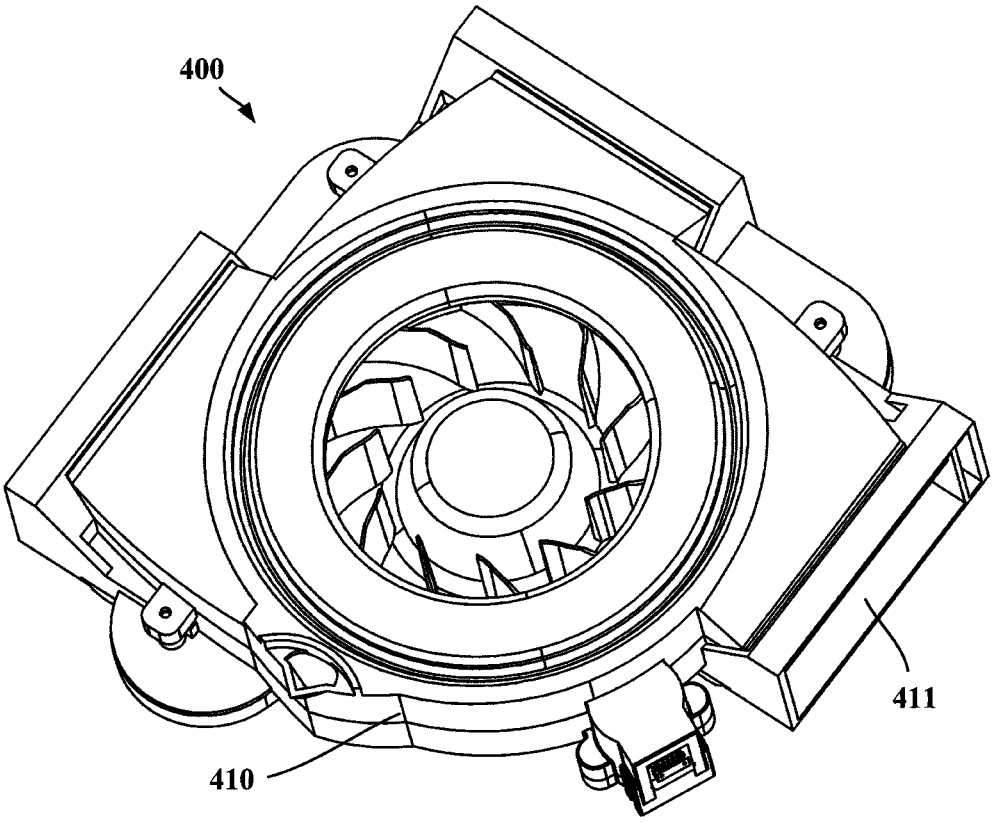
FIG. 1 is a schematic structure diagram of a branched air supply device according to an embodiment of the present application.
Figure 2:
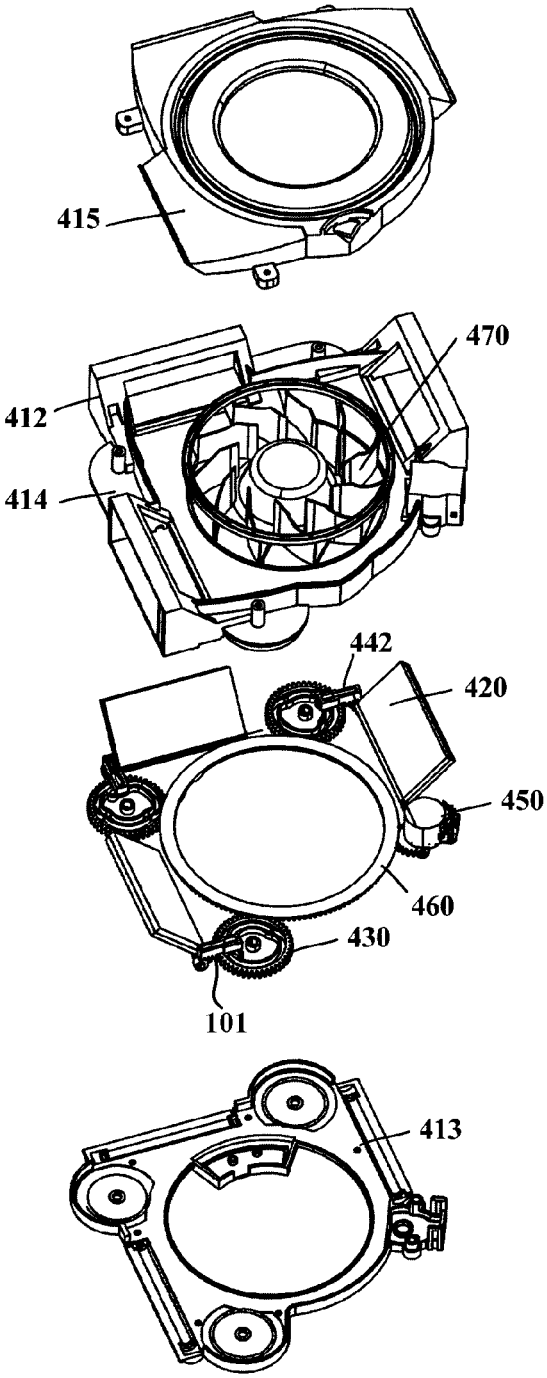
FIG. 2 is a schematic exploded diagram of a branched air supply device according to an embodiment of the present application.
Figure 3:
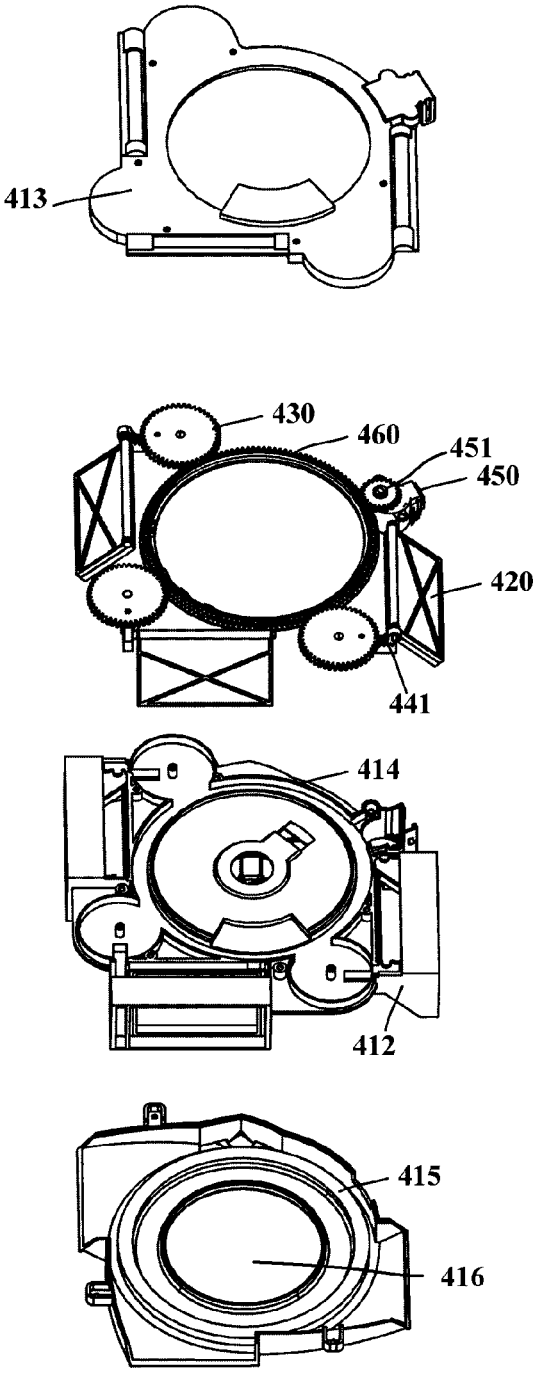
FIG. 3 is a schematic exploded diagram, from another view angle, of a branched air supply device according to an embodiment of the present application.
Figure 4:
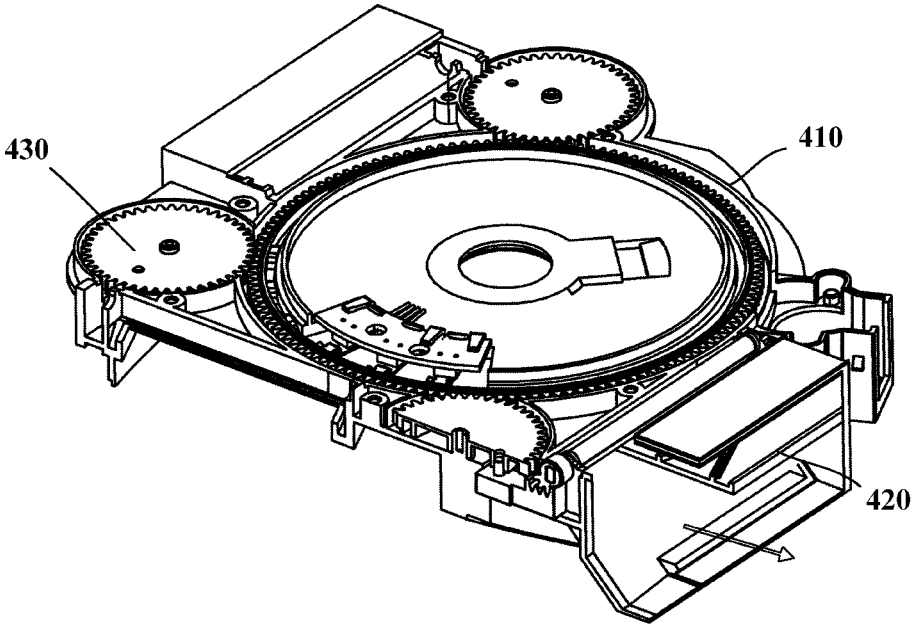
FIG. 4 is a schematic local structure diagram of a branched air supply device, with one baffle in a state of opening a corresponding air supply port, according to an embodiment of the present application.
Figure 5:
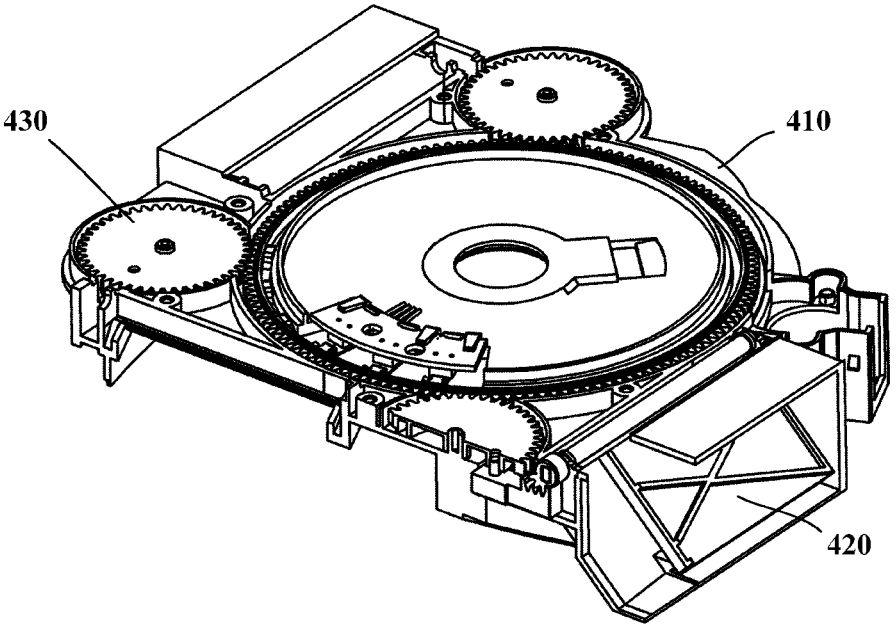
FIG. 5 is a schematic local structure diagram of a branched air supply device, with one baffle in a state of closing a corresponding air supply port, according to an embodiment of the present application.

FIG. 1 is a schematic structure diagram of a branched air supply device according to an embodiment of the present application. As shown in FIG. 1, with reference to FIG. 2 to FIG. 13, the embodiment of the present application provides a branched air supply device 400 for a refrigerator 10. The branched air supply device 400 may include a shell 410, a plurality of baffles 420, a plurality of transmission assemblies and a driving device.

The shell 410 is provided with a peripheral wall portion 412, a plurality of air supply ports 411 are arranged on the peripheral wall portion 412, and are sequentially arranged at intervals in a circumferential direction of the shell 410. The air supply ports 411 may also be air supply passages with a certain length. Further, the shell 410 may further include structures arranged at two ends of the peripheral wall portion 412. Each of the baffles 420 is rotatably arranged at one of the air supply ports 411 so as to adjust an air outlet area of the corresponding air supply port 411 by rotating to different rotating positions, for example, the corresponding air supply port 411 may be opened or closed so as to realize complete air outlet and zero air outlet. Each of the transmission assemblies may be arranged at the shell 410, and may be provided with a rotating member 430 and a first transmission mechanism. The rotating member 430 may be in a turntable shape, and may also be in an annular disk shape. Each of the first transmission mechanisms is configured to transmit a rotational motion of the corresponding rotating member 430 to one of the baffles 420, so that the baffle 420 is at rest or rotates. That is, in a rotating process of the rotating member 430, the first transmission mechanism may drive the baffle 420 to rotate and may keep the baffle 420 to be at rest. The driving device may be arranged at the shell 410, and may be provided with a driving source 450 and a second transmission mechanism. The second transmission mechanism is configured to transmit one motion, output by the driving source 450, to the plurality of rotating members 430, so that each of the rotating members 430 is at rest or rotates. That is, when the driving source 450 outputs motions such as the rotational motion or a linear motion, the plurality of rotating members 430 may be driven by the second transmission mechanism to rotate or to keep to be at rest.

The plurality of baffles 420 of the branched air supply device 400 in the embodiment of the present application may controllably distribute cold air to the plurality of air supply ports 411 to realize various air outlet states, so that goals of controlling an open or closed state of an air outlet duct communicating with each of the air supply ports 411 and/or adjusting the air outlet quantity in each air outlet duct may be achieved, and the refrigerating capacity requirements of different storage chambers, or the refrigerating capacity requirements in different positions of one storage chamber, or the refrigerating capacity requirements of different storage spaces in one storage chamber are further met. In a concrete work process, the driving source 450 drives the plurality of rotating members 430 to rotate through the second transmission mechanism. When rotating, each of the rotating members 430 drives the corresponding baffle 420 to turn through the first transmission mechanism, so as to open or close or adjust the corresponding air supply port 411. Further, the first transmission mechanism may enable the baffle 420 to turn or to be at rest, and further enables the plurality of air supply ports 411 to realize various air outlet states, such as an air outlet state that one air supply port 411 is closed while the other air supply port 411 is opened, or an air outlet state that the two air supply ports 411 are closed at the same time. Further, the plurality of air supply ports 411 of the branched air supply device 400 in the embodiment of the present application are distributed in a circumferential way, so that circumferential air inlet and air outlet of the plurality of (for example, three) air supply ports 411 may be realized, an integral structure design of the branched air supply device 400 may be facilitated, and the branched air supply device 400 may realize a simple and compact structure and a reasonable layout. The branched air supply device 400 may be conveniently installed in a refrigerator, and air ducts may be conveniently and reasonably arranged in the refrigerator.

In some embodiments of the present application, the sizes of the plurality of air supply ports 411 are identical or different, or the sizes of parts of air supply ports 411 are identical. For example, if the quantity of the air supply ports 411 is three, the sizes of two air supply ports 411 are identical, and the third air supply port 411 is bigger, and the size of the bigger air supply port 411 may be 1.5 to 2.5 times of the size of the two smaller air supply ports 411. Preferably, the sizes of the plurality of air supply ports 411 are set to be identical.

In some further embodiments of the present application, the shell 410 further includes a damper bottom cover 413, a base 414 and a damper top cover 415. The base 414 is arranged at one side of the damper bottom cover 413, and the plurality of rotating members 430 are arranged between the base 414 and the damper bottom cover 413. The peripheral wall portion 412 is arranged at one side, backing to the damper bottom cover 413, of the base 414. Concretely, the peripheral wall portion 412 may include a peripheral wall extending out from the base 414, and an air supply port 411 wall extending from the peripheral wall in the radial direction of the shell 410. A position, near the base 414, of the air supply port 411 wall may be provided with a notch for installing the baffle 420. When the baffle 420 opens the corresponding air supply port 411, the side surface, through which the airflow flows, of the baffle 420 and the side surface, backing to the damper bottom cover 413, of the base 414 are preferably positioned in a same plane so as to facilitate the flow of the airflow. The damper top cover 415 is arranged at one end, far away from the base 414, of the peripheral wall portion 412, and an air inlet port 416 is arranged on the peripheral wall portion 412 or the damper top cover 415. Preferably, the air inlet port 416 is arranged at the damper top cover 415. In some alternative embodiments of the present application, the shell 410 may further include the base 414 and the damper top cover 415, but not include the damper bottom cover 413. The plurality of rotating members 430 are arranged on the inner surface of the base 414.

In some embodiments of the present application, a cam slide groove 110 is arranged in one side surface of each rotating member 430. For example, the cam slide groove 110 is arranged in the side surface, backing to the base 414, of each rotating member 430. Each of the first transmission mechanisms includes a first gear 441 and a transmission device. The first gear 441 is connected to the corresponding baffle 420, and may be positioned in an accommodating cavity formed at one side of the corresponding air supply port 411 and on the shell 410. The transmission device is provided with an insertion portion 111 inserted into the corresponding cam slide groove 110 so as to be at rest or move in the radial direction of the corresponding rotating member 430 when the corresponding rotating member 430 rotates. Additionally, the transmission device is further provided with first teeth 101 engaged with the corresponding first gear 441 so as to drive the corresponding baffle 420 to rotate when moving in the radial direction of the corresponding rotating member 430. Each of the rotating members 430 and the corresponding first gear 441 are positioned at a same side of the corresponding transmission device. A space in the shell 410 may be sufficiently used, so that a structure of the branched air supply device 400 is compact.

In some preferred embodiments of the present application, each of the transmission devices includes a sliding strip 113, a slide block 120 and an elastic member 121. One end of the sliding strip 113 is provided with the first teeth 101; one side, facing the corresponding rotating member 430, of the sliding strip 113 is provided with a groove 103. The slide block 120 is arranged in the groove 103, and is provided with the insertion portion 111. The elastic member 121 is arranged between the slide block 120 and one side wall, vertical to a length direction of the sliding strip 113, of the groove 103. If the elastic member is a compressed spring, the elastic member may be positioned at one end, far away from the first gear 441, of the slide block. If the elastic member is an extension spring, the elastic member may be positioned at one end, near the first gear 441, of the slide block. Through such arrangement, the teeth on the first gear 441 and the teeth on the sliding strip tightly cooperate without tooth clearance, and the rotation of the baffles 420 and the like is stable. In other embodiments of the present application, the transmission device may be a rack 442. One end, far away from the baffle 420, of the rack 442 may be provided with the insertion portion 111. The insertion portion 111 is a bulge. In some embodiments of the present application, the first gear 441 is a full gear or a non-full gear.

In some embodiments of the present application, the second transmission mechanism includes a second gear 460. A plurality of second teeth are arranged on each rotating member 430. The second gear 460 is directly or indirectly connected to the driving source 450. The second gear 460 is an external gear, and is engaged with the second teeth on the plurality of rotating members 430 so as to drive the plurality of rotating members 430 to rotate. Preferably, a circle of teeth are arranged on each rotating member 430, i.e., each rotating member 430 may be equivalent to a gear. The second gear 460 is preferably a gear ring with external teeth, and is arranged between the base 414 and the damper bottom cover 413.

Further, the driving source 450 is a motor; the second transmission mechanism further includes a third gear 451 arranged at an output shaft of the motor; and the third gear 451 is engaged with the second gear 460. The peripheral wall portion 412 is provided with an accommodating portion for accommodating the motor and the third gear. In some alternative embodiments of the present application, the driving source 450 is a motor; the second transmission mechanism is also provided with a fourth gear arranged at the output shaft of the motor, and a fifth gear engaged with the fourth gear; the fifth gear and the second gear 460 are coaxially arranged and synchronously rotate. In other alternative embodiments, the second gear 460 may be directly arranged at the output shaft of the motor. By using a gear set for transmission, a rotational motion of the motor may be transmitted to the rotating members 430 and the baffles 420 in a decelerated way. The motion stability of the baffles 420 may be ensured, and the noise is low.

In some embodiments of the present application, in order to improve air supply efficiency or directly apply the branched air supply device 400 to air outlet of a cooling chamber of the refrigerator, the branched air supply device 400 further includes an air providing device 470. The air supply device 470 is arranged in the shell 410 and is configured to enable an airflow to enter the shell 410 and to flow out of the shell 410 through one or more of the plurality of air supply ports 411. Preferably, the air providing device 470 is a centrifugal impeller, and is configured to enable the airflow to enter the shell 410 in an axial direction of the shell 410. When the branched air supply device 400 is applied to the air outlet of the cooling chamber, an air inlet port of the branched air supply device 400 may be directly arranged at an air outlet port of the cooling chamber, the axial air inlet and radial air outlet may be conveniently realized, and outlet air is guided in a vertical plane.

In some embodiments of the present application, preferably, each baffle 420 at least has two states of opening and closing the corresponding air supply port 411. Additionally, the plurality of rotating members 430 have the same size and rotate synchronously. The quantity of the air supply ports 411 may be N, and N is a natural number being greater than or equal to 2. In order to enable that the plurality of air supply ports 411 have $2^N$ air outlet states, i.e., the plurality of air supply ports 411 have $2^N$ air outlet combined states, each cam slide groove 110 includes at least $2^N-1$ slide groove sections 102. When the insertion portion 111 is positioned at each end point of each slide groove section 102, the corresponding baffle 420 closes the corresponding air supply port 411 or completely opens the corresponding air supply port 411. Through such arrangement, when the plurality of rotating members 430 synchronously rotate for degrees of a central angle corresponding to one slide groove section 102 in each time, the plurality of air supply ports 411 have one air outlet state, and further, the plurality of air supply ports 411 have $2^N$ air outlet states.

For example, as shown in FIG. 6 to FIG. 13, the quantity of the air supply ports 411 may be three, including a first port, a second port and a third port sequentially arranged in the circumferential direction of the shell 410, then the corresponding cam slide grooves 110 may be first, second and third cam slide grooves, and the corresponding baffles 420 may be a first baffle 421, a second baffle 422 and a third baffle 423. Eight air outlet states are realized. Each cam slide groove 110 may have eight slide groove sections 102.

Figure 6:
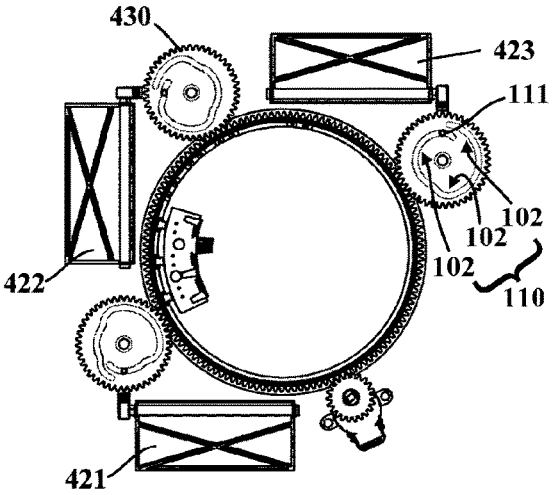
FIG. 6 to FIG. 13 respectively show schematic structure diagrams of various air outlet states in a branched air supply device according to embodiments of the present application.

As shown in FIG. 6, the first port, the second port and the third port may be all in a closed state, and the starting end of a first slide groove section of each cam slide groove 110 may enable the corresponding baffle 420 to be in a closed state.

Figure 7:
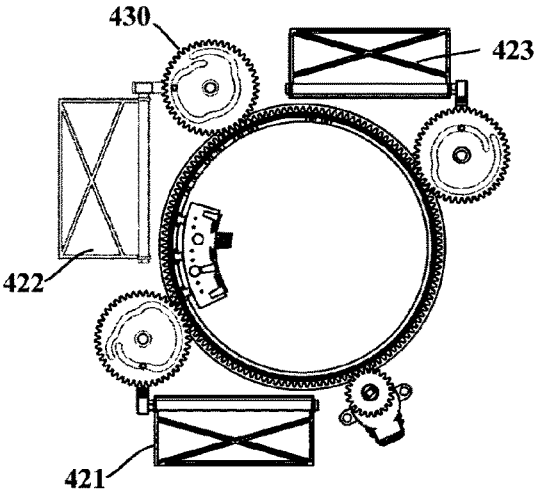

As shown in FIG. 7, the first port and the third port may be in a closed state, the second port may be in an open state, the tail end of a first slide groove section (i.e., the starting end of a second slide groove section) of the second cam slide groove may enable the corresponding baffle 420 to be in an open state, two ends of the first slide groove section of the second cam slide groove have a distance difference value in the radial direction of the rotating member 430, so that the first slide groove section of the second cam slide groove is in a non-circular-arc shape, and the baffle 420 is driven to rotate to the open state in the rotating process of the corresponding rotating member 430; and tail ends of first slide groove sections (i.e., starting ends of second slide groove sections) of the first cam slide groove and a third cam slide groove may enable the corresponding baffle 420 to be in the closed state, the first slide groove sections of the second cam slide groove and the third cam slide groove may be both in circular arc shapes, and the baffle 420 may not be driven to rotate in the rotating process of the corresponding rotating member 430.

Figure 8:
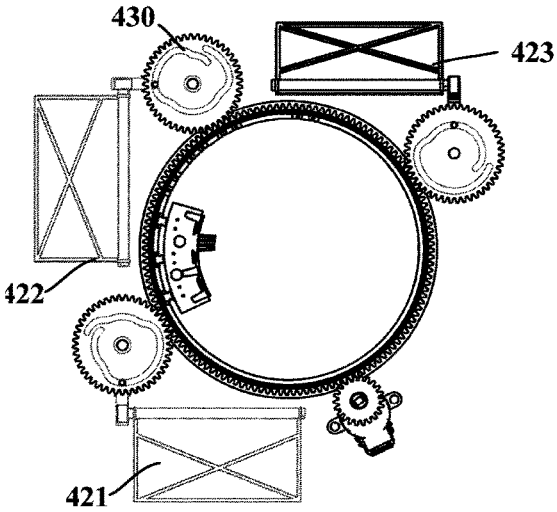

As shown in FIG. 8, the third port may be in the closed state, the first port and the second port may be in the open state, the tail end of a second slide groove section (i.e., the starting end of a third slide groove section) of the first cam slide groove may enable the corresponding baffle 420 to be in the open state, two ends of the second slide groove section of the first cam slide groove have a distance difference value in the radial direction of the rotating member 430, so that the second slide groove section of the first cam slide groove is in a non-circular-arc shape, and the baffle 420 is driven to rotate to the open state in a rotating process of the corresponding rotating member 430; and tail ends of second slide groove sections (i.e., starting ends of third slide groove sections) of the second cam slide groove and the third cam slide groove may enable the corresponding baffles 420 to be respectively in the corresponding open and corresponding closed states, then the second slide groove sections of the second cam slide groove and the third cam slide groove may be both in circular arc shapes, and the baffle 420 may not be driven to rotate in the rotating process of the corresponding rotating member 430.

Figure 9:
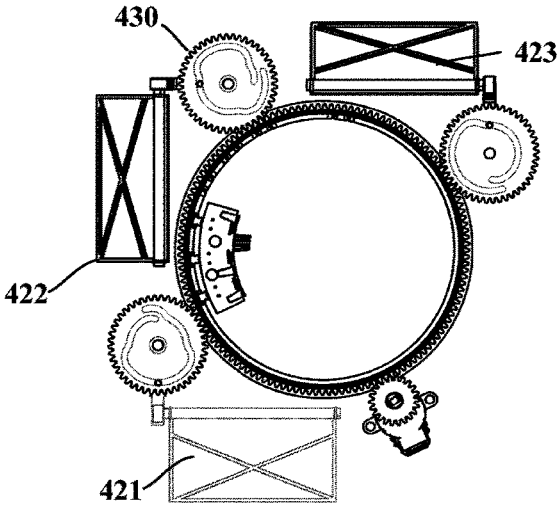

As shown in FIG. 9, the second port and the third port may be in the closed state, the first port may be in the open state, the tail end of the third slide groove section (i.e., the starting end of a fourth slide groove section) of the second cam slide groove may enable the corresponding baffle 420 to be in the closed state, two ends of the third slide groove section of the first cam slide groove have a distance difference value in the radial direction of the rotating member 430, so that the third slide groove section of the first cam slide groove is in a non-circular-arc shape, and the baffle 420 is driven to rotate to the closed state in the rotating process of the corresponding rotating member 430. The tail end of the third slide groove section (i.e., the starting end of a fourth slide groove section) of the first cam slide groove may enable the corresponding baffle 420 to be in the open state, the third slide groove section of the first cam slide groove may be in the circular arc shape, and the baffle 420 may not be driven to rotate in the rotating process of the corresponding rotating member 430. The tail end of the third slide groove section (i.e., the starting end of a fourth slide groove section) of the third cam slide groove may enable the corresponding baffle 420 to be in the closed state, the third slide groove section of the third cam slide groove may be in the circular arc shape, and the baffle 420 may not be driven to rotate in the rotating process of the corresponding rotating member 430.

Figure 10:
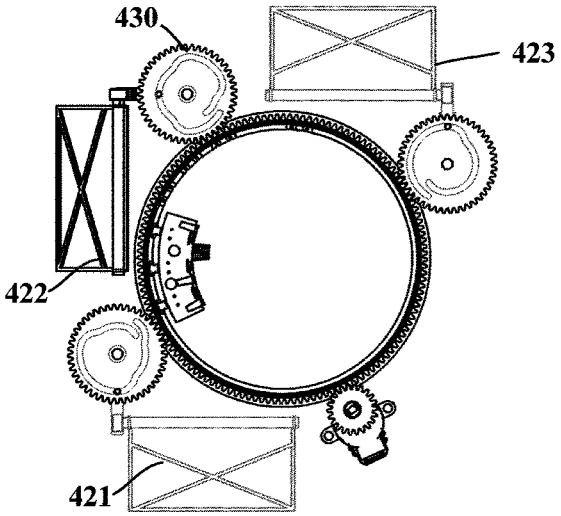

As shown in FIG. 10, the first port and the third port may be in the open state, the second port may be in the closed state, the tail end of the fourth slide groove section (i.e., the starting end of a fifth slide groove section) of the first cam slide groove may enable the corresponding baffle 420 to be in the open state, the fourth slide groove section of the first cam slide groove may be in the circular arc shape, and the baffle 420 may not be driven to rotate in the rotating process of the corresponding rotating member 430. The tail end of the fourth slide groove section (i.e., the starting end of a fifth slide groove section) of the second cam slide groove may enable the corresponding baffle 420 to be in the open state, the fourth slide groove section of the second cam slide groove may be in the circular arc shape, and the baffle 420 may not be driven to rotate in the rotating process of the corresponding rotating member 430. The tail end of the fourth slide groove section (i.e., the starting end of a fifth slide groove section) of the third cam slide groove may enable the corresponding baffle 420 to be in the open state, two ends of the fourth slide groove section of the third cam slide groove have a distance difference value in the radial direction of the rotating member 430, so that the fourth slide groove section of the first cam slide groove is in the non-circular-arc shape, and the baffle 420 is driven to rotate to the open state in the rotating process of the corresponding rotating member 430.

Figure 11:
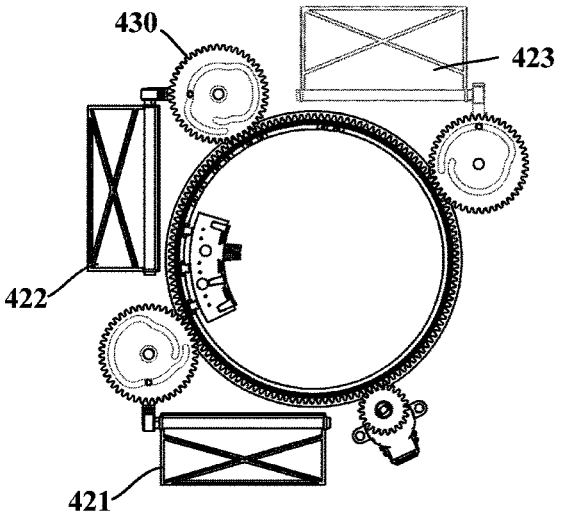

As shown in FIG. 11, the third port may be in the open state, the first port and the second port may be in the closed state, the tail end of the fifth slide groove section (i.e., the starting end of a sixth slide groove section) of the first cam slide groove may enable the corresponding baffle 420 to be in the closed state, two ends of the fifth slide groove section of the first cam slide groove have a distance difference value in the radial direction of the rotating member 430, so that the fifth slide groove section of the first cam slide groove is in the non-circular-arc shape, and the baffle 420 is driven to rotate to the closed state in the rotating process of the corresponding rotating member 430. The tail ends of the fifth slide groove sections (i.e., the starting ends of sixth slide groove sections) of the second cam slide groove and the third cam slide groove may enable the corresponding baffles 420 to be respectively in the corresponding closed and corresponding open states, the fifth slide groove sections of the second cam slide groove and the third cam slide groove may be in the circular arc shapes, and the baffles 420 may not be driven to rotate in the rotating process of the corresponding rotating members 430.

Figure 12:
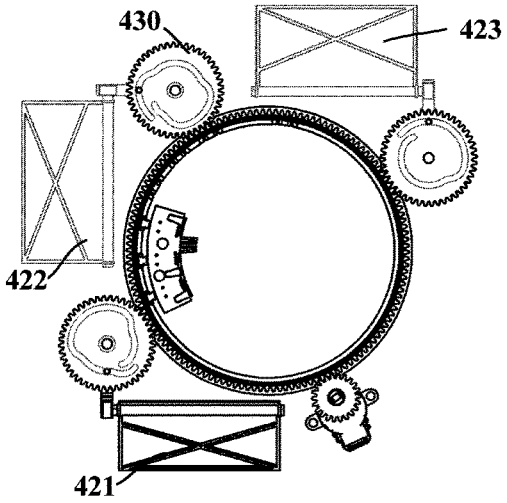

As shown in the FIG. 12, the second port and the third port may be in the open state, the first port may be in the closed state, the tail end of the six slide groove section (i.e., the starting end of a seventh slide groove section) of the second cam slide groove may enable the corresponding baffle 420 to be in the open state, two ends of the six slide groove section of the second cam slide groove has a distance difference value in the radial direction of the rotating member 430, so that the sixth slide groove section of the second cam slide groove in the non-circular-arc shape, and the baffle 420 is driven to rotate to the open state in the rotating process of the corresponding rotating member 430. The tail ends of the sixth slide groove sections (i.e., the starting ends of seventh slide groove sections) of the first cam slide groove and the third cam slide groove may enable the corresponding baffles 420 to be respectively in the corresponding closed and corresponding opened states, the sixth slide groove sections of the first cam slide groove and the third cam slide groove may be in the circular arc shapes, and the baffle 420 may not be driven to rotate in the rotating process of the corresponding rotating member 430.

Figure 13:
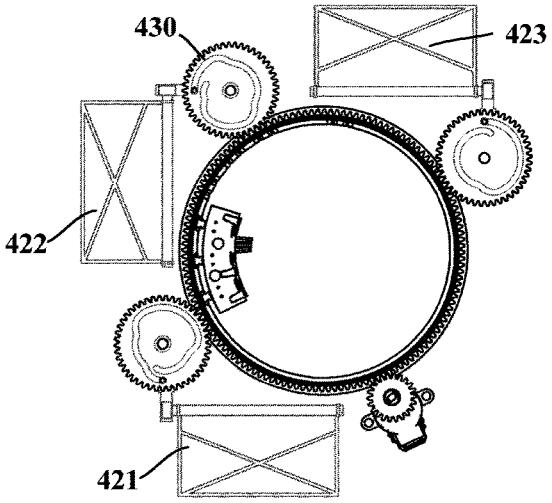

As shown in FIG. 13, the first port, the second port and the third port may be all in the open state, the tail end of the seventh slide groove section of the first cam slide groove may enable the corresponding baffle 420 to be in the open state, two ends of the seventh slide groove section of the first cam slide groove have a distance difference value in the radial direction of the rotating member 430, so that the seventh slide groove section of the first cam slide groove is in the non-circular-arc shape, and the baffle 420 is driven to rotate to the open state in the rotating process of the corresponding rotating member 430. The tail ends of the seventh slide groove sections of the second cam slide groove and the third cam slide groove may enable the corresponding baffles 420 to be in the open state, the seventh slide groove sections of the second cam slide groove and the third cam slide groove may be in the circular arc shapes, and the baffles 420 may not be driven to rotate in the rotating process of the corresponding rotating members 430.

In other embodiments of the present application, the first cam slide groove, the second cam slide groove and the third cam slide groove may also use other combined states of the slide groove sections, and $2^N$ air outlet states of the plurality of air supply ports 411 may be realized.

Figure 14:
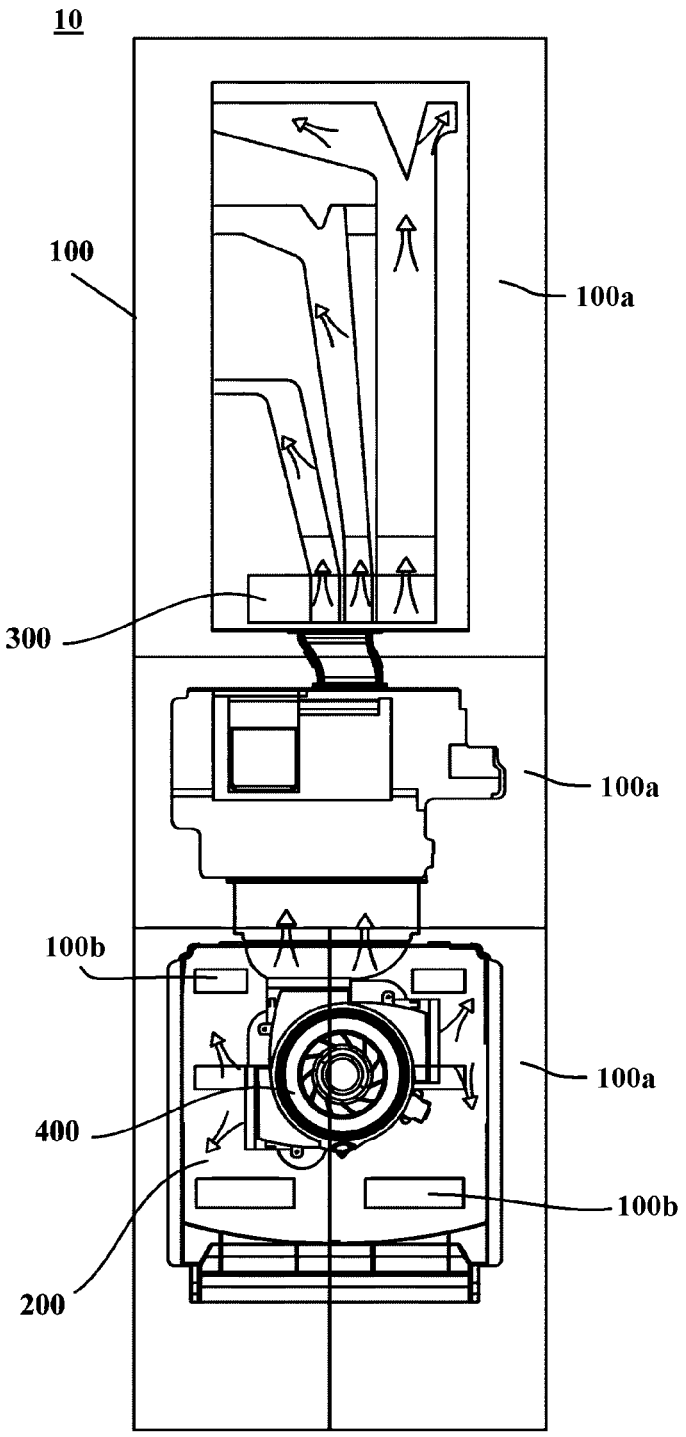
FIG. 14 is a schematic structure diagram of a refrigerator according to an embodiment of the present application.
Figure 15:
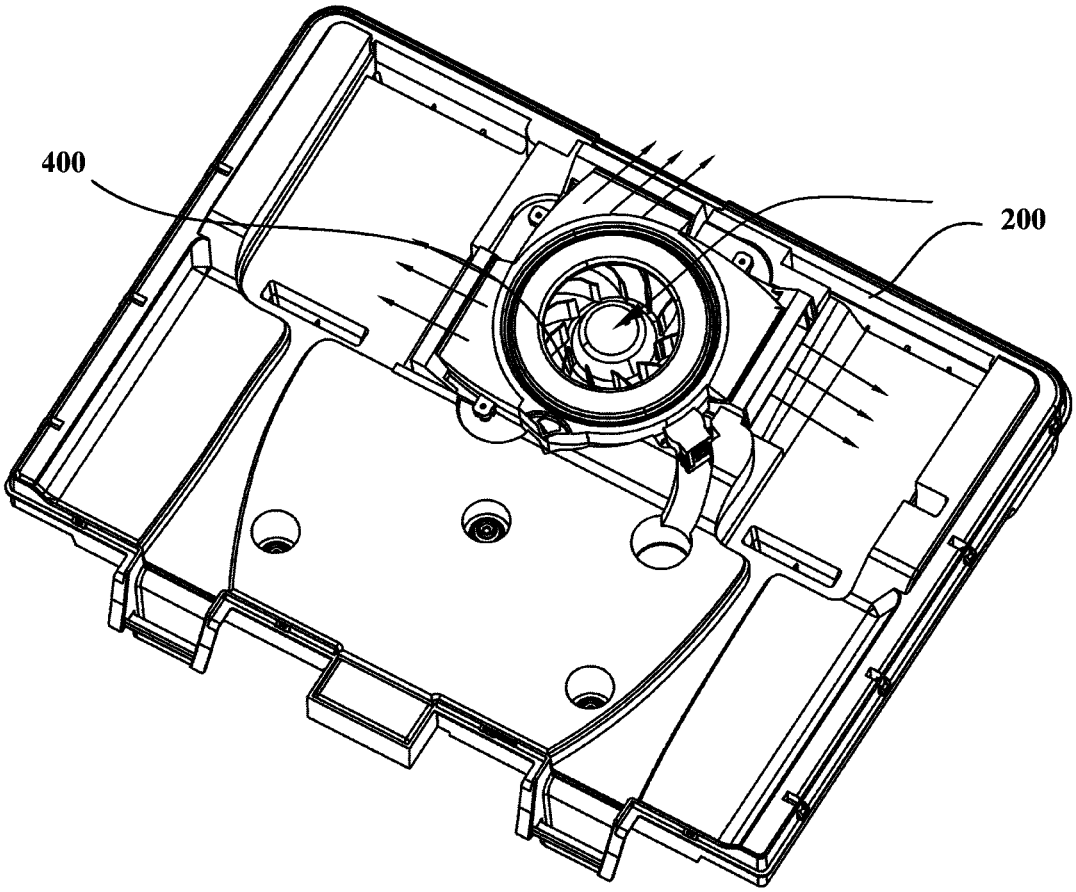
FIG. 15 is a schematic structure diagram of a branched air supply device arranged on an air duct assembly according to an embodiment of the present application.

FIG. 14 is a schematic structure diagram of a refrigerator according to an embodiment of the present application. As shown in the FIG. 14, with reference to FIG. 15, the embodiment of the present application further provides the refrigerator 10. The refrigerator 10 is provided with a refrigerator body 100. The refrigerator body 100 is internally provided with a storage space 100*a*, and the storage space may include one or more of storage chambers. Each storage chamber may also be separated into a plurality of small storage spaces by storage plates/storage racks. Further, an air duct assembly 200 and the branched air supply device 400 which is arranged in the air duct assembly 200 and is provided by any one of the above embodiments are also arranged in the refrigerator. The air duct assembly 200 is arranged in the refrigerator body 100, and is provided with a plurality of cold air outlet ports 100*b*. The plurality of cold air outlet ports are communicated with the storage space. Each of the air supply ports 411 of the branched air supply device 400 communicates with one or more cold air outlet ports. Additionally, each cold air outlet port communicates with one air supply port 411, so that the airflow entering the shell 410 of the branched air supply device 400 flows to the storage space through one or more of the plurality of air supply ports 411 of the branched air supply device 400.

In some specific embodiments of the present application, the refrigerator body 100 is also provided with a cooling chamber. The air duct assembly 200 may be provided with an installing cavity and a plurality of cold air outlet ports. Each cold air outlet port directly communicates with one storage chamber or communicates with the storage chamber through another pipeline. The air duct assembly 200 is arranged at the front side of the cooling chamber, and the installing cavity is aligned with an air outlet port of the cooling chamber. The branched air supply device 400 is arranged in the installing cavity, and the air inlet port of the branched air supply device 400 is aligned with the air outlet port of the cooling chamber. Each of the air supply ports 411 communicates with one cold air outlet port so as to supply air to the plurality of storage cambers in an adjustable way. Concretely, the refrigerator body 100 may include a cold storage chamber, a left freezing chamber and a right freezing chamber. The left freezing chamber and the right freezing chamber are positioned at the lower side of the cold storage chamber. The branched air supply device 400 is provided with three air supply ports 411, namely an upper air outlet port positioned at the upper part of the shell 410, a left air outlet port positioned at the left side of the shell 410, and a right air outlet port positioned at the right side of the shell 410. The upper air outlet port may communicate with the cold storage chamber. The left air outlet port communicates with the left freezing chamber. The right air outlet port communicates with the right freezing chamber. In some alternative embodiments of the present application, the branched air supply device 400 may also supply air to a plurality of positions of one storage chamber.

In some further embodiments of the present application, partial or total cold air outlet ports of the air duct assembly 200 may supply air to a plurality of positions of one storage chamber through an air duct pipe assembly. For example, the upper air outlet port may supply air to the cold storage chamber through the air duct pipe assembly.

An air inlet duct and a plurality of air outlet ducts may be defined in the air duct pipe assembly. Each air outlet duct is provided with one or more cold air outlet ports. The air duct pipe assembly may be set into a straight row type branched air supply device 300. The straight row type branched air supply device 300 may include a plurality of air supply ports arranged in one row. A baffle is arranged at each air supply port, and the baffle may rotate to different rotating positions to adjust the air outlet area of the corresponding air supply port. The straight row type branched air supply device 300 communicates with the air inlet duct. The plurality of air supply ports of the straight row type branched air supply device 300 respectively communicate with the plurality of air outlet ducts, so that the airflow from the air inlet duct enters the corresponding air outlet duct in a controlled/distributive manner and then enters the storage space. The plurality of air outlet ducts may be configured to enable the airflow flowing out of the air duct pipe assembly to respectively enter one storage chamber (such as the cold storage chamber) of the refrigerator from a plurality of positions on a chamber wall of the storage chamber. For example, the air supply ports of the straight row type branched air supply device 300 may be three, for example, a first port, a second port and a third port. The air outlet ducts may be three, for example, a first air duct communicating with the first port, a second air duct communicating with the second port, and a third air duct communicating with the third port. The first air duct may include two or four cold air outlet ports symmetrically arranged at the upper part of the back wall of the cold storage chamber. The first air duct may be provided with one cold air outlet port arranged at the lower part of the back wall of the cold storage chamber. The second air duct may be positioned between the first air duct and the second air duct, and is provided with one or two cold air outlet ports arranged at the middle part of the back wall of the cold storage chamber. Further, the cold storage chamber may also be separated into three small storage spaces by two storage racks, and each air outlet duct communicates with one small storage space.

The branched air supply device 400 and/or the straight row type branched air supply device 300 in the refrigerator of the embodiment of the present application may achieve the goals of controlling the open and closed states of the air outlet duct and adjusting the air capacity. When cold air is needed in some positions of the refrigerator, the cold air outlet ports in needed positions are opened, and the cold air outlet ports are closed if the cold air is not needed, so that the constancy of the temperature in the refrigerator is controlled. An optimum storage environment is provided for food in the refrigerator. The nutrition loss of the food is reduced. Electricity consumption of the refrigerator may be reduced, and energy sources are saved.

Figure 16:
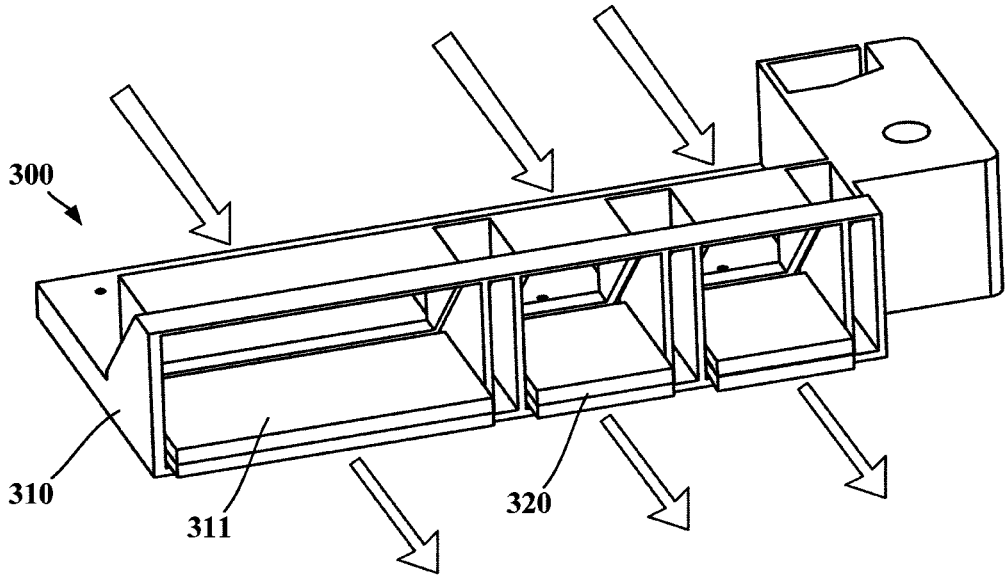
FIG. 16 is a schematic structure diagram of a straight row type branched air supply device of a refrigerator according to an embodiment of the present application.
Figure 17:
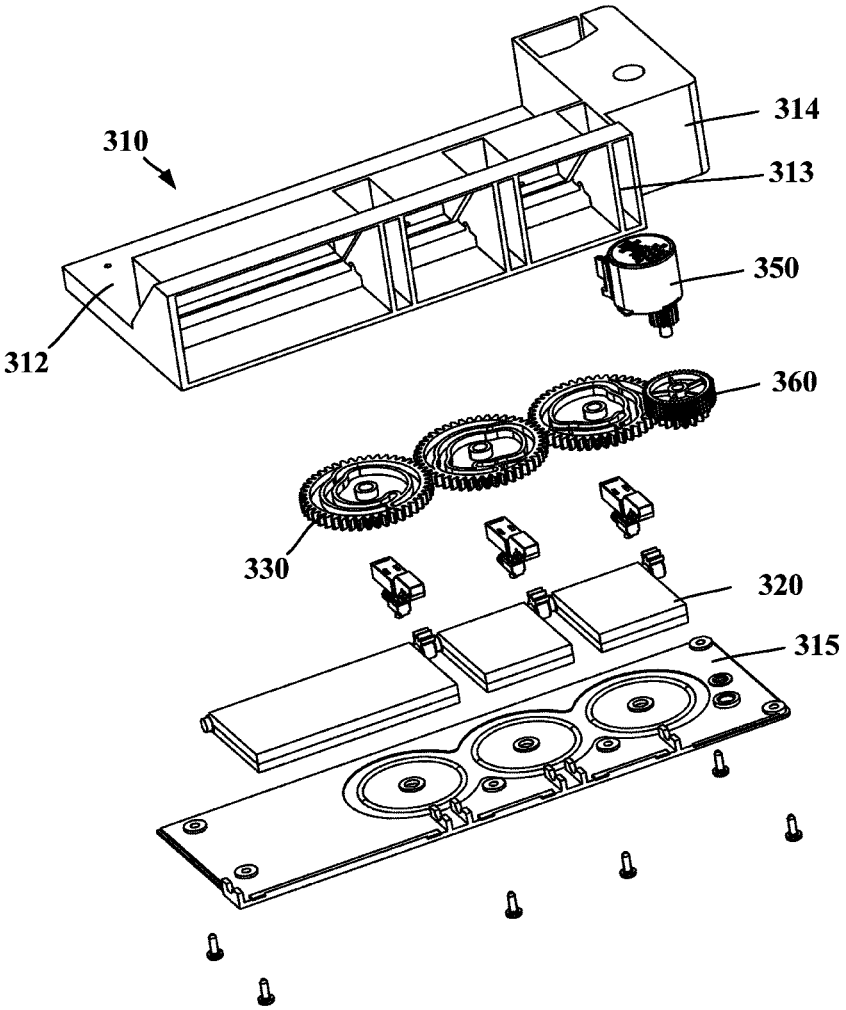
FIG. 17 is a schematic exploded diagram of a straight row type branched air supply device of a refrigerator according to an embodiment of the present application.
Figure 18:
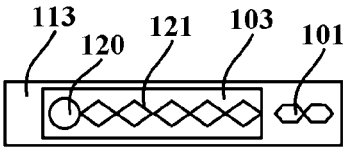
FIG. 18 is a schematic local structure diagram of a sliding strip of a branched air supply device according to an embodiment of the present application.

In some further embodiments of the present application, as shown in FIG. 16 and FIG. 17, the straight row type branched air supply device 300 may include a shell 310, a plurality of baffles 320, a plurality of transmission assemblies 330 and a driving assembly. The shell 310 may include a plurality of air supply ports 311. The air supply port 311 may also be an air supply duct with a certain length. The structure of each of the transmission assemblies 330 is identical to the structure of the transmission assembly 330 in the branched air supply device. The driving assembly may be arranged in the shell 310, and may include a driving source 350 and a third transmission mechanism 360. The third transmission mechanism 360 is configured to transmit one motion, output by the driving source 350, to the plurality of rotating members so that each of the rotating members is at rest or rotates.

Further, the shell 310 of the straight row type branched air supply device 300 includes a rotating member installing portion 312, an air supply port portion 313, a driving assembly installing portion 314 and a cover plate portion 315. The air supply port portion 313 is provided with a plurality of air supply ports 311 positioned at a downstream side of the rotating member installing portion 312 in an airflow flowing direction. The driving assembly installing portion 314 is arranged at one ends of the rotating member installing portion 312 and the air supply port portion 313. The rotating member installing portion 312 includes a substrate. An installing groove is formed in one side, far away from the airflow flowing, of the substrate, and the plurality of rotating members are rotatably arranged in the installing groove. Each of baffles 320 is rotatably arranged at the air supply port portion 313. Additionally, an accommodating cavity is formed in one side of each of air supply ports 311 so as to accommodate the partial or total first transmission mechanism corresponding to the baffle 320 for regulating the air outlet area of the air supply port 311. The driving assembly installing portion 314 is configured to accommodate the driving assembly. The cover plate portion 315 covers the installing groove and one end of the driving assembly installing portion 314.

For example, in order to conveniently illustrate the structure of the shell 310, the substrate may include an upper surface and a lower surface; an installing groove is formed in the lower surface; and the airflow may flow through the upper surface. The air supply port portion 313 may include a bottom plate integrally formed with the substrate, an air supply port side wall upwards extending from the bottom plate, and an air supply port top wall in opposite arrangement to the bottom plate. An installing space for installing a rotating shaft of the baffle 320 is arranged at one side, near the substrate, of the bottom plate. The baffle 320 may be attached to the upper surface of the bottom plate when the corresponding air supply port 311 is opened, so that the upper surface of the baffle 320 may be flushed with the upper surface of the bottom plate, and to facilitate the air supply. The driving assembly installing portion 314 is a hollow shell structure with a lower port, so that the installation of the driving assembly and the installation of the cover plate portion 315 are sealed. A cam slide groove is formed in the side surface, facing the substrate, of each of the rotating members. The transmission device is positioned at the upper side of the rotating members and the baffles 320 in the open state. The space in the shell 310 may be sufficiently used, so that the structure of the straight row type branched air supply device 300 is compact.

In some embodiments of the present application, the third transmission mechanism 360 includes a sixth gear. The sixth gear is directly or indirectly connected to the driving source 350, and is engaged with teeth on one rotating member, and the teeth on one rotating member are engaged with the teeth on the other rotating member. Further, the driving source 350 is a motor. The third transmission mechanism 360 further includes a gear set. The gear set includes a seventh gear arranged at an output shaft of the motor and an eighth gear engaged with the seventh gear. The eighth gear and the sixth gear are in coaxial arrangement and rotate synchronously. In some alternative embodiments, the sixth gear may be directly arranged at the output shaft of the motor.

In some embodiments of the present application, preferably, each of the baffles 320 of the straight row type branched air supply device 300 is at least enabled to have two states of opening and closing the corresponding air supply port 311. Additionally, the plurality of rotating members have the same size and rotate synchronously. The quantity of the air supply ports 311 may be N, and N is a natural number being greater than or equal to 2. In order to enable that the plurality of air supply ports 311 have 2N air outlet states, i.e., the plurality of air supply ports 311 have 2N air outlet combined states, each of the cam slide grooves includes at least 2N−1 slide groove sections. When the insertion portion is positioned at each end point of each slide groove section, the corresponding baffle 320 closes the corresponding air supply port 311 or completely opens the corresponding air supply port 311. Through such arrangement, when the plurality of rotating members synchronously rotate for degrees of a central angle corresponding to one slide groove section in each time, the plurality of air supply ports 311 have one air outlet state, and further, the plurality of air supply ports 311 of the straight row type branched air supply device 300 have 2N air outlet states.

So far, those skilled in the art shall recognize that although a number of exemplary embodiments of the present application have been shown and described in detail herein, many other variations or modifications in accordance with the principles of the present application may be directly ascertained or derived from the present disclosure without departing from the spirit and scope of the present application. Therefore, the scope of the present application should be understood and appreciated to cover all such other variations or modifications.

The invention claimed is:

1. A branched air supply device for a refrigerator, comprising:

a shell, provided with a peripheral wall portion, a plurality of air supply ports being arranged on the peripheral wall portion and sequentially arranged at intervals in a circumferential direction of the shell;

a plurality of baffles, each of the baffles being rotatably arranged at each one of the air supply ports so as to adjust an air outlet area of the corresponding air supply port by rotating to different rotating positions;

a plurality of transmission assemblies, each of the transmission assemblies being provided with a rotating member and a first transmission mechanism; each of the first transmission mechanisms being configured to transmit a rotational motion of the corresponding rotating member to one of the baffles so that the baffle is at rest or rotates; and a driving device, provided with a driving source and a second transmission mechanism, the second transmission mechanism being configured to transmit one motion, output by the driving source, to the plurality of rotating members so that each of the rotating members is at rest or rotates;

wherein the second transmission mechanism comprises a second gear;

wherein a plurality of second teeth is arranged on each of the rotating members;

wherein the second gear is directly or indirectly connected to the driving source, the second gear is an external gear, and is engaged with the second teeth on the plurality of rotating members so as to drive the plurality of rotating members to rotate;

wherein the shell further comprises:

a damper bottom cover;

a base, arranged at one side of the damper bottom cover, the second gear and the plurality of rotating members being arranged between the base and the damper bottom cover; and the peripheral wall portion being arranged at one side, backing to the damper bottom cover of the base: and a damper top cover, arranged at one end, away from the base, of the peripheral wall portion; and an air inlet port being arranged on the peripheral wall portion or the damper top cover.

2. The branched air supply device according to claim 1, wherein a cam slide groove is formed in one side surface of each of the rotating members; and each of the first transmission mechanisms comprises:

a first gear, connected to the corresponding baffle; and a transmission device, provided with an insertion portion inserted into the corresponding cam slide groove so as to be at rest or move in a radial direction of the corresponding rotating member when the corresponding rotating member rotates; and the transmission device further being provided with first teeth engaged with the corresponding first gear so that the corresponding baffle is driven to rotate when the transmission device moves in the radial direction of the corresponding rotating member.

3. The branched air supply device according to claim 2, wherein each of the transmission devices comprises a rack, the rack is provided with the first teeth, and one end of the rack is provided with the insertion portion; or each of the transmission devices comprises:

a sliding strip, one end of the sliding strip being provided with the first teeth, and one side, facing the corresponding rotating member, of the sliding strip being provided with a groove;

a slide block, arranged in the groove and provided with the insertion portion; and an elastic member, arranged between the slide block and one side wall of the groove, which side wall of the groove is vertical to a length direction of the sliding strip.

4. The branched air supply device according to claim 1, wherein the driving source is a motor; the second transmission mechanism further comprises a third gear arranged at an output shaft of the motor; and the third gear is engaged with the second gear.

5. The branched air supply device according to claim 1, further comprising:

an air providing device, arranged in the shell and configured to enable an airflow to enter the shell and to flow out of the shell through one or more of the plurality of air supply ports.

6. The branched air supply device according to claim 5, wherein the air providing device is a centrifugal impeller, and is configured to enable the airflow to enter the shell in an axial direction of the shell.

7. The branched air supply device according to claim 2, wherein the quantity of the air supply ports is N, and the plurality of rotating members synchronously rotate; and each cam slide groove comprises at least $2^N-1$ slide groove sections, when the insertion portion is positioned at each end point of each slide groove section, the corresponding baffle closes the corresponding air supply port or completely opens the corresponding air supply port, so that when the plurality of rotating members synchronously rotate for degrees of a central angle corresponding to one slide groove section in each time, the plurality of air supply ports have one air outlet state, and further, the plurality of air supply ports have $2^N$ air outlet states.

8. A refrigerator, comprising:

a refrigerator body, internally provided with a storage space;

an air duct assembly, arranged in the refrigerator body and provided with a plurality of cold air outlet ports; the plurality of cold air outlet ports being communicated with the storage space; and the branched air supply device according to claim 1, arranged in the air duct assembly; each air supply port of the branched air supply device communicating with one or more of the plurality of cold air outlet ports; and each cold air outlet port communicating with one air supply port so that an airflow entering the shell of the branched air supply device flows to the storage space through one or more of the plurality of air supply ports of the branched air supply device.

* * * * *